US010246999B2

(12) United States Patent
Persano

(10) Patent No.: US 10,246,999 B2
(45) Date of Patent: Apr. 2, 2019

(54) LOCKING SYSTEM TO PREVENT ROTATION OF TOOLHOLDER

(71) Applicant: Caterpillar Paving Products Inc., Brooklyn Park, MN (US)

(72) Inventor: Mario Persano, Poggio Renatico (IT)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 295 days.

(21) Appl. No.: 15/078,581

(22) Filed: Mar. 23, 2016

(65) Prior Publication Data

US 2017/0275992 A1 Sep. 28, 2017

(51) Int. Cl.

| | |
|---|---|
| ***E21C 35/18*** | (2006.01) |
| ***E21C 25/10*** | (2006.01) |
| ***E01C 23/088*** | (2006.01) |

(52) U.S. Cl.

CPC ..... *E21C 35/18* (2013.01); *E01C 23/088* (2013.01); *E21C 25/10* (2013.01)

(58) Field of Classification Search

CPC ..... E21C 35/19–35/197

See application file for complete search history.

(56) References Cited

U.S. PATENT DOCUMENTS

| | | | | |
|---|---|---|---|---|
| 4,337,980 | A * | 7/1982 | Krekeler | B28D 1/188 175/315 |
| T103,602 | I4 * | 11/1983 | Rettkowski | E21C 35/197 175/354 |
| 4,632,463 | A | 12/1986 | Sterwerf, Jr. | |
| 4,693,518 | A * | 9/1987 | Sulosky | E21C 35/1933 299/102 |
| 5,029,944 | A * | 7/1991 | Komotzki | E21C 35/19 299/107 |
| 5,106,166 | A | 4/1992 | O'Neill | |
| 6,176,552 | B1 | 1/2001 | Topka, Jr. et al. | |
| 6,644,755 | B1 | 11/2003 | Kammerer | |
| 8,770,669 | B2 | 7/2014 | Wachsmann et al. | |
| 8,894,155 | B2 | 11/2014 | Elfgen | |
| 8,950,821 | B2 | 2/2015 | Fundakowski et al. | |
| 9,004,610 | B2 | 4/2015 | Erdmann et al. | |
| 9,114,463 | B2 | 8/2015 | Dufour et al. | |
| 2007/0152495 | A1 | 7/2007 | Sollami | |

(Continued)

FOREIGN PATENT DOCUMENTS

DE 102011055877 A1 6/2013

*Primary Examiner* — Janine M Kreck

(74) *Attorney, Agent, or Firm* — Miller, Matthias & Hull

(57) ABSTRACT

A mounting block assembly and method for assembling is disclosed. The mounting block assembly may comprise a mounting block and a toolholder. The mounting block may include a flighting portion, a mounting portion and a protrusion. The mounting portion defines a first bore that is configured to receive a toolholder. The toolholder includes a generally cylindrical sidewall that defines an axis and defines a second bore that is configured to receive a stem of a cutting bit. The sidewall includes a pair of radially outward extending prongs that define a first recess between the prongs. The first recess is configured to interlockably receive the protrusion when the toolholder is disposed in the mounting portion, wherein the interlocked configuration of the toolholder and the mounting block inhibit rotational movement of the toolholder about the axis.

10 Claims, 5 Drawing Sheets

(56) References Cited

U.S. PATENT DOCUMENTS

| | | | | |
|---|---|---|---|---|
| 2009/0085396 | A1* | 4/2009 | Chiang | B28D 1/188 299/102 |
| 2009/0091177 | A1 | 4/2009 | Moore | |
| 2014/0035346 | A1* | 2/2014 | Fundakowski | E21C 25/10 299/87.1 |
| 2014/0346841 | A1 | 11/2014 | Wachsmann | |

* cited by examiner

LOCKING SYSTEM TO PREVENT ROTATION OF TOOLHOLDER

TECHNICAL FIELD

The present disclosure generally relates to toolholders and, more particularly, relates to toolholders on milling drums and the like that are used with cold planers, rotary mixers and similar machines.

BACKGROUND

Roadways have been built to facilitate vehicular travel. Over time, and with wear and tear, the surface of a roadway can eventually become misshapen, non-planar, or otherwise unsuitable for vehicular traffic. In order to rehabilitate the roadway for continued vehicular use, the spent roadway surface, for example asphalt, cement, concrete, or the like, is removed in preparation for resurfacing.

Cold planers, sometimes also called road mills or scarifiers, are machines that typically include a frame quadrilaterally supported by tracked or wheeled drive units. The frame provides mounting for an engine, an operator's station, and a milling drum. The milling drum, fitted with cutting bits, is rotated through a suitable interface by the engine to break up the surface of the roadway. In a typical configuration, multiple rows of cutting bits are oriented on an external surface of the milling drum.

Similarly, machines such as rotary mixers, which may be used to cut, pulverize and mix soil to stabilize the soil for a strong road base, have a rotating component on which cutting tools are disposed. Such rotary mixers typically include a frame quadrilaterally supported by tracked or wheeled drive units. The frame provides mounting for an engine, an operator's station, and a hood member under which a milling drum/mixing rotor is disposed. As such a rotary mixer advances along the ground surface to be stabilized, the milling drum/mixing rotor and cutting tools penetrate the ground surface.

The cutting bits of such machines are typically positioned in a toolholder. The toolholder is disposed in a mounting that is attached to the milling drum (or mixing rotor). During use, forces acting upon the cutting bit and toolholder can cause the toolholder and cutting bit to rotate clockwise or counterclockwise in the mounting. Such rotation may, over time, cause frictional wear between components and may loosen the toolholder in its mounting.

U.S. Pat. No. 8,770,669 ("Wachsmann et al.") issued Jul. 8, 2014 describes a cutting tool configuration for a ground milling machine. The cutting tool comprises a cutter holder, a cutting tool and a wear disk. The cutting tool rotates in the cutter holder. A rotation lock between the cutter holder and the wear disk is caused by at least one groove formed on the outer circumference of the wear disc and a guide formed on the cutter holder. While beneficial, a better design is needed.

SUMMARY OF THE DISCLOSURE

In accordance with one aspect of the disclosure, a mounting block assembly for a milling drum is disclosed. The mounting block assembly may comprise a mounting block and a toolholder. The mounting block may include a flighting portion, a mounting portion and a protrusion. The flighting portion is configured to engage an outer cylindrical surface of the milling drum. The mounting portion defines a first bore that is configured to receive a toolholder. The protrusion is configured to extends away from the mounting portion. The flighting portion, the mounting portion and the protrusion are integral. The toolholder includes a generally cylindrical sidewall that defines an axis and defines a second bore that extends in a direction parallel to the axis. The second bore is configured to receive a stem of a cutting bit. The sidewall includes a pair of radially outward extending prongs that define a first recess between the prongs. The first recess is configured to interlockably receive the protrusion when the toolholder is disposed in the mounting portion, wherein the interlocked configuration of the toolholder and the mounting block inhibit rotational movement of the toolholder about the axis.

In accordance with another aspect of the disclosure, a method of assembling a mounting block assembly on a milling drum is disclosed. The method may comprise: fixedly securing a mounting block to the milling drum. The mounting block may include a flighting portion configured to engage an outer cylindrical surface of the milling drum, a mounting portion that defines a first bore configured to receive a toolholder, and a protrusion that extends away from the mounting portion. In an embodiment the flighting portion, the mounting portion and the protrusion are integral. The method may further include positioning a toolholder above the mounting block. The toolholder includes a generally cylindrical sidewall that defines an axis and a second bore. The second bore extends in a direction parallel to the axis and is configured to receive a stem of a cutting bit. The sidewall includes a pair of radially outward extending prongs that define a first recess between the prongs. The first recess is configured to interlockably receive the protrusion when the toolholder is disposed in the mounting portion, wherein the interlocked configuration of the toolholder and the mounting block inhibit rotational movement of the toolholder about the axis. The method further includes aligning the protrusion inside the prongs, and disposing the toolholder in a mounting portion of the mounting block, wherein the protrusion is disposed between the prongs in an interlocking relationship, wherein the interlocked configuration of the toolholder and the mounting block inhibit rotational movement of the toolholder about the axis.

In accordance with a further aspect of the disclosure, a milling drum is disclosed. The milling drum may comprise an outer cylindrical surface, a mounting block and a toolholder. The mounting block includes a flighting portion configured to engage an outer cylindrical surface of the milling drum, a mounting portion that defines a first bore configured to receive a toolholder, and a protrusion that extends away from the mounting portion. In an embodiment, the flighting portion, the mounting portion and the protrusion are integral. The toolholder includes a generally cylindrical sidewall that defines an axis and a second bore that extends in a direction parallel to the axis. The second bore is configured to receive a stem of a cutting bit. The sidewall includes a pair of radially outward extending prongs that define a first recess therebetween. The first recess is configured to interlockably receive the protrusion when the toolholder is disposed in the mounting portion, wherein the interlocked configuration of the toolholder and the mounting block inhibit rotational movement of the toolholder about the axis.

DETAILED DESCRIPTION

Figure 1:
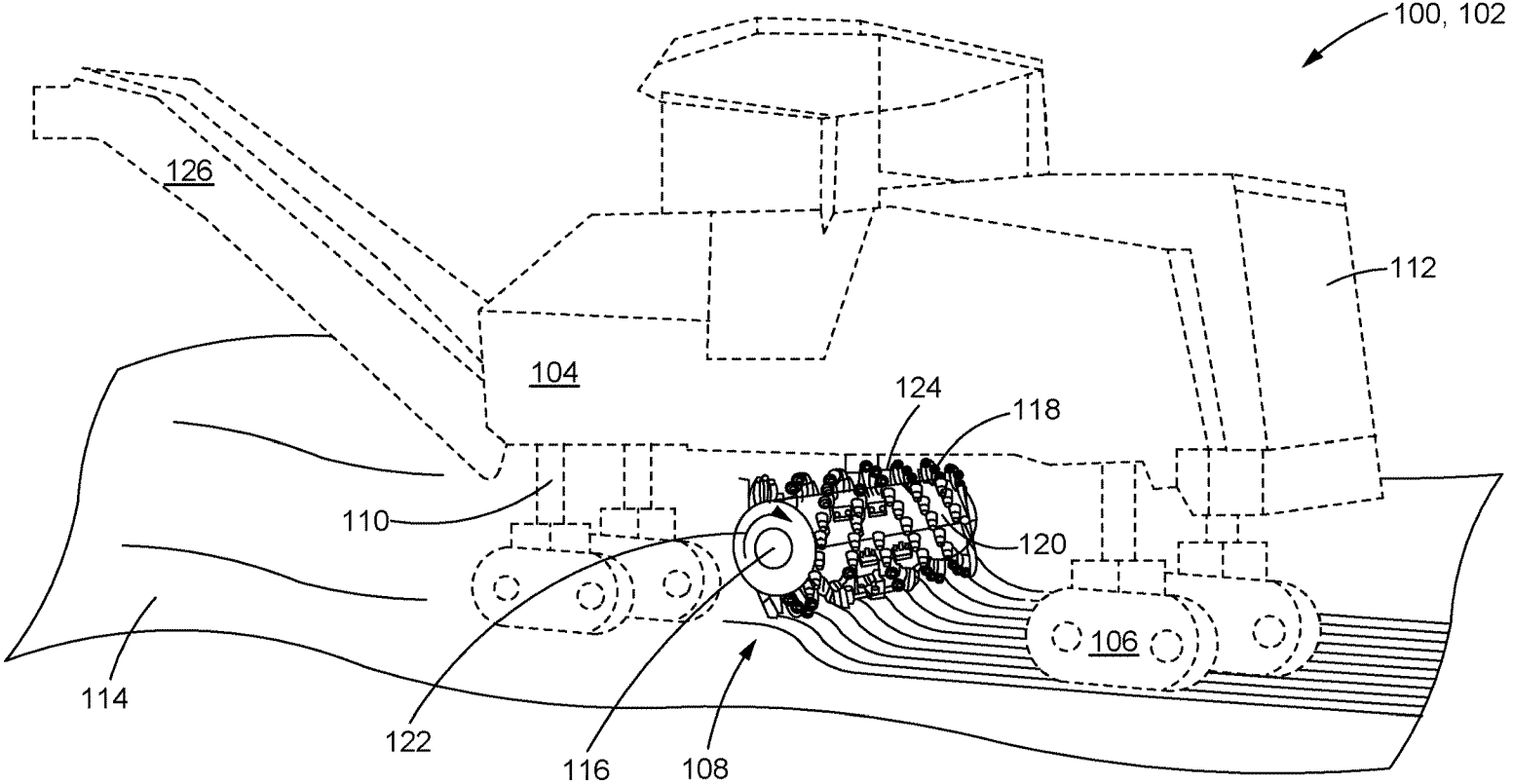
FIG. 1 is a pictorial illustration of an exemplary machine that includes an exemplary embodiment of a milling drum.

FIG. 1 illustrates one example of a machine 100 that incorporates the features of the present disclosure. The exemplary machine 100 may be a vehicle such as a cold planer 102, rotatory mixer, or the like. A "cold planer" is a machine used to remove layers of hardened asphalt, cement or other road surfaces from an existing road.

The exemplary cold planer 102 may include a frame 104 connected to one or more traction units 106, and a milling drum 108 supported from frame 104 at a general center of cold planer 102 between traction units 106. Traction units 106 may each include either a wheel or a track section that is pivotally connected to frame 104 by a lifting column 110. Lifting columns 110 may be adapted to controllably raise, lower, and/or tilt the frame 104 relative to the associated traction units 106. An engine 112 (or other power source) may be configured to electrically, mechanically, hydraulically, and/or pneumatically power traction units 106, milling drum 108 and lifting columns 110.

The milling drum 108 may include components rotated by engine 112 to fragment and remove chunks of asphalt and/or other material from a road surface 114. In one embodiment, the milling drum 108 may include a rotary head 116 having a plurality of mounting block assemblies 118 fixedly attached to an outer cylindrical surface 120 of the milling drum 108 by welding or the like. Milling drum 108 is rotationally driven by engine 112 in the direction of an arrow 122. One or more paddles 124 may be located near the center of rotary head 116 to transfer the fragmented material onto a nearby conveyor 126.

Figure 3:
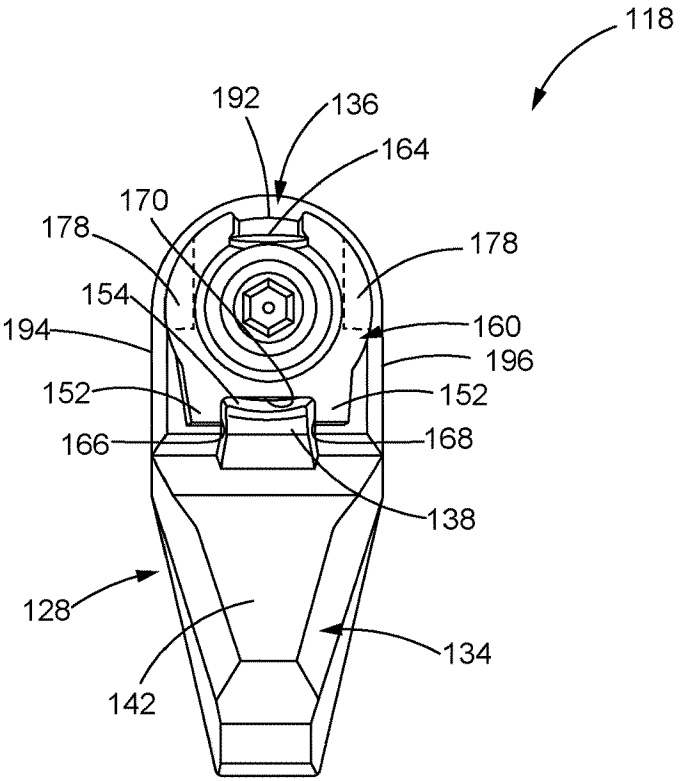
FIG. 3 is another view of the mounting block assembly of FIG. 2.
Figure 2:
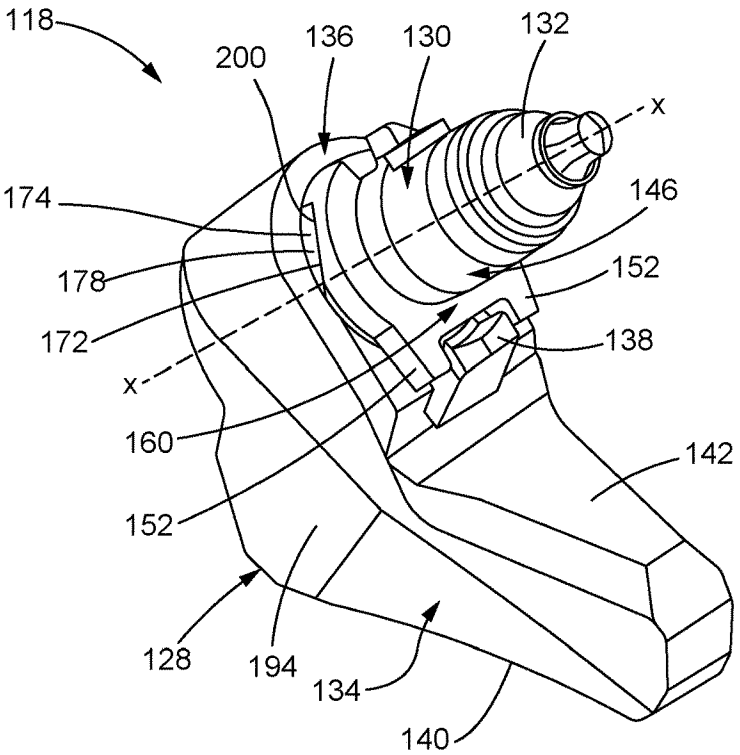
FIG. 2 is a perspective view of an exemplary embodiment of a mounting block assembly utilized on the exemplary milling drum of FIG. 1, the mounting block assembly includes a mounting block, a toolholder and a cutting bit.
Figure 4:
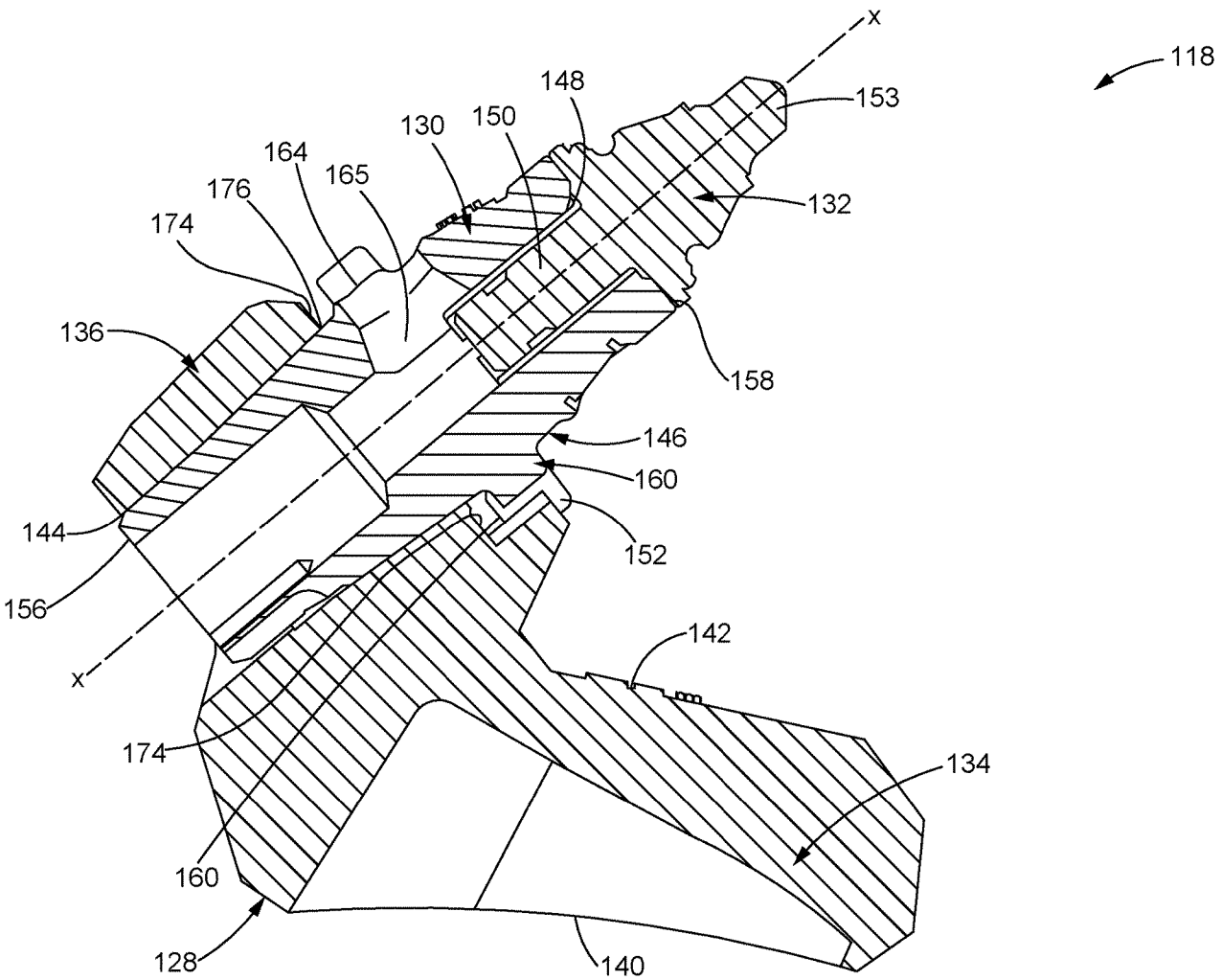
FIG. 4 is a cross-section view of the exemplary embodiment of the mounting block assembly.

As shown in FIGS. 2-4, each mounting block assembly 118 comprises a mounting block 128 and a removeable toolholder 130. The mounting block assembly 118 may further comprise a removeable cutting bit 132.

The mounting block 128 has a first side 194 and a second side 196. The mounting block 128 comprises a flighting portion 134, a mounting portion 136 and a protrusion 138. The flighting portion 134, the mounting portion 136 and the protrusion 138 may be integrally formed as a single component.

The flighting portion 134 may be generally block-like and configured to engage the outer cylindrical surface 120 of the milling drum 108 (see FIGS. 1 and 2). The flighting portion 134 may include a base surface 140 and an upper surface 142 located opposite base surface 140.

The mounting portion 136 is disposed on top of the flighting portion 134 and defines a first bore 144 (see FIG. 4). The first bore 144 is configured to removeably receive a toolholder 130 via a press-fit interference. The mounting portion 136 includes an upper face 174 encircling an opening 176 of the first bore 144. A ledge 160 (discussed below) of the toolholder 130 is disposed proximal or adjacent to the upper face 174 when the toolholder 130 is fully inserted into the mounting portion 136.

The protrusion 138 is disposed either on top of the mounting portion 136 or on top of the flighting portion 134. The protrusion 138 extends in a direction away from the mounting portion 136. More specifically, the protrusion 138 may extend or protrude above the mounting portion 136. In an embodiment, the protrusion 138 may extend in a direction generally parallel to the axis X.

The toolholder 130 (FIGS. 2-5) has a first end 156 and an opposing second end 158. First end 156 may be configured for insertion within the first bore 144 of mounting portion 136, while second end 158 may be configured to receive cutting bit 132. The toolholder 130 includes a generally cylindrical sidewall 146.

Figure 5:
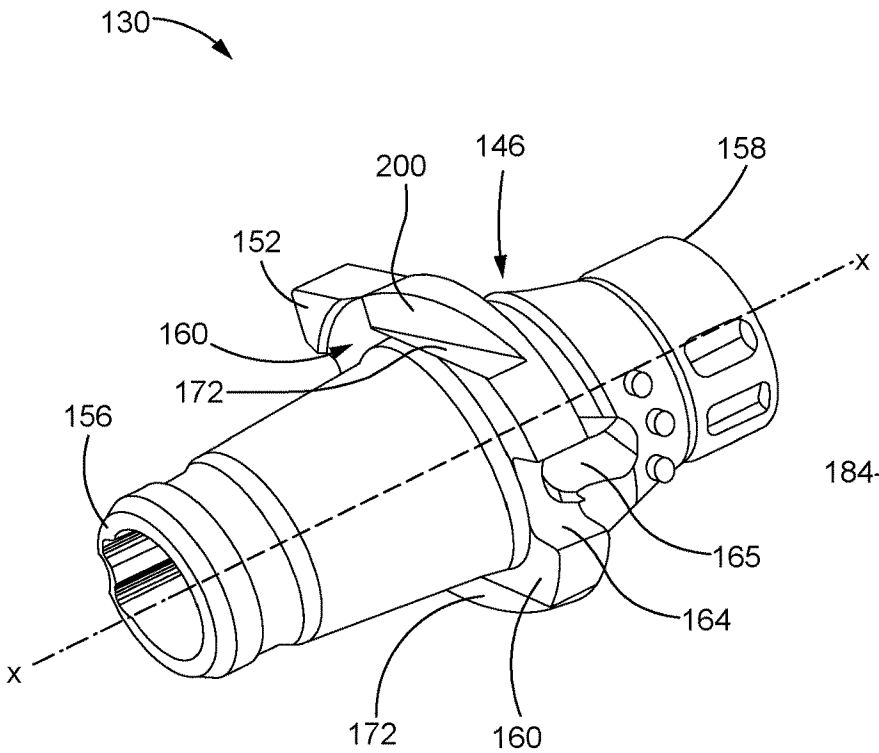
FIG. 5 is a perspective view of the exemplary embodiment of the toolholder shown in FIG. 2.

The sidewall 146 defines an axis X and a second bore 148. The second bore 148 extends in a direction parallel to the axis X and is configured to removeably receive a stem 150 of the cutting bit 132 (FIG. 4) via press-fit interference. As best seen in FIGS. 2-3 and 5, the sidewall 146 includes a ledge 160 and pair of radially outward extending prongs 152 disposed at a general mid-portion of toolholder 130, between the first and second ends 156, 158. The ledge 160 may be generally annular in shape. In an embodiment the ledge 160 may be oriented perpendicularly to the axis X. The pair of prongs 152 may extend radially outward from the ledge 160. In an embodiment, each prong 152 may extend in a direction generally perpendicular to the axis X (FIG. 4).

The pair of prongs 152 define a first recess 154 therebetween (FIG. 3). The first recess 154 is configured to interlockably receive the protrusion 138 when the toolholder 130 is disposed in the mounting portion 136. The interlocked configuration of the toolholder 130 and the mounting block 128 inhibits rotational movement (clockwise or counterclockwise) of the toolholder 130 about the axis X. In some embodiments with close tolerances, the interlocked configuration of the toolholder 130 and the mounting block 128 fully stops (or immobilizes) any rotational movement (clockwise or counterclockwise) of the toolholder 130 about the axis X. In one embodiment, the first recess 154 includes a first side 166, second side 168 and a back 170. A portion of the ledge 160 may be the back 170 of the first recess 154. As depicted in FIG. 3, the first side 166 is opposite from and parallel to the second side 168. Further, both the first side 166 and the second side 168 may extend perpendicularly from the back 170.

The ledge 160 may include at least one tapered cutout 172 (best seen in FIG. 5). In one embodiment, the ledge 160 may include a pair of opposing tapered cutouts 172 disposed on opposite sides of the sidewall 146. When the toolholder 130 is fully inserted into the mounting portion 136, each tapered cutout 172 and the upper face 174 (see FIG. 6) of the mounting portion 136 forms (defines) a wedge channel 178 (FIGS. 2-3).

Figure 6:
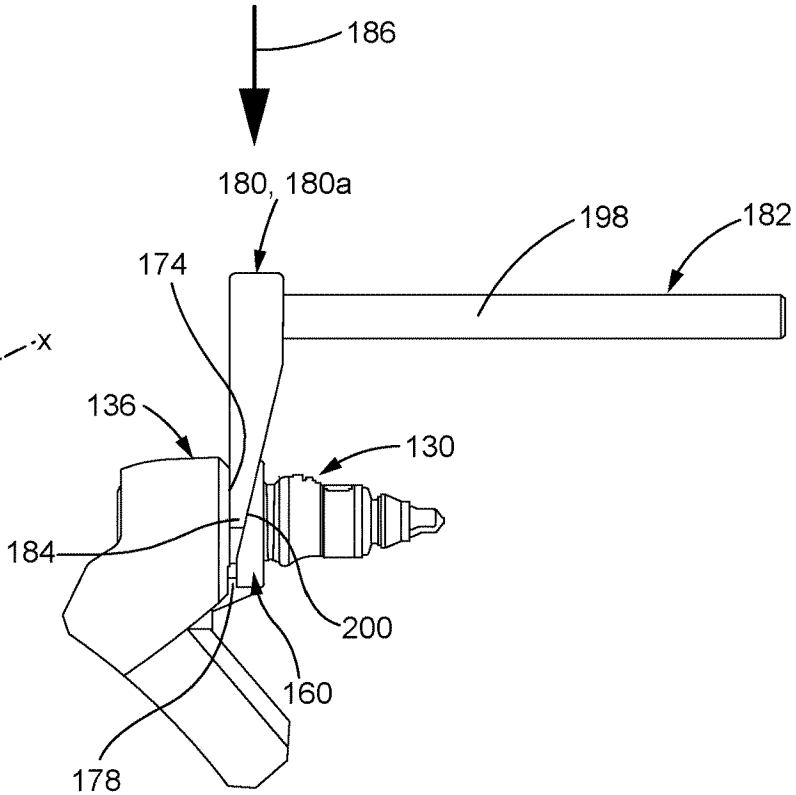
FIG. 6 is an illustration of the toolholder being pried, with a hammer, off of the mounting block of FIG. 2.
Figure 7:
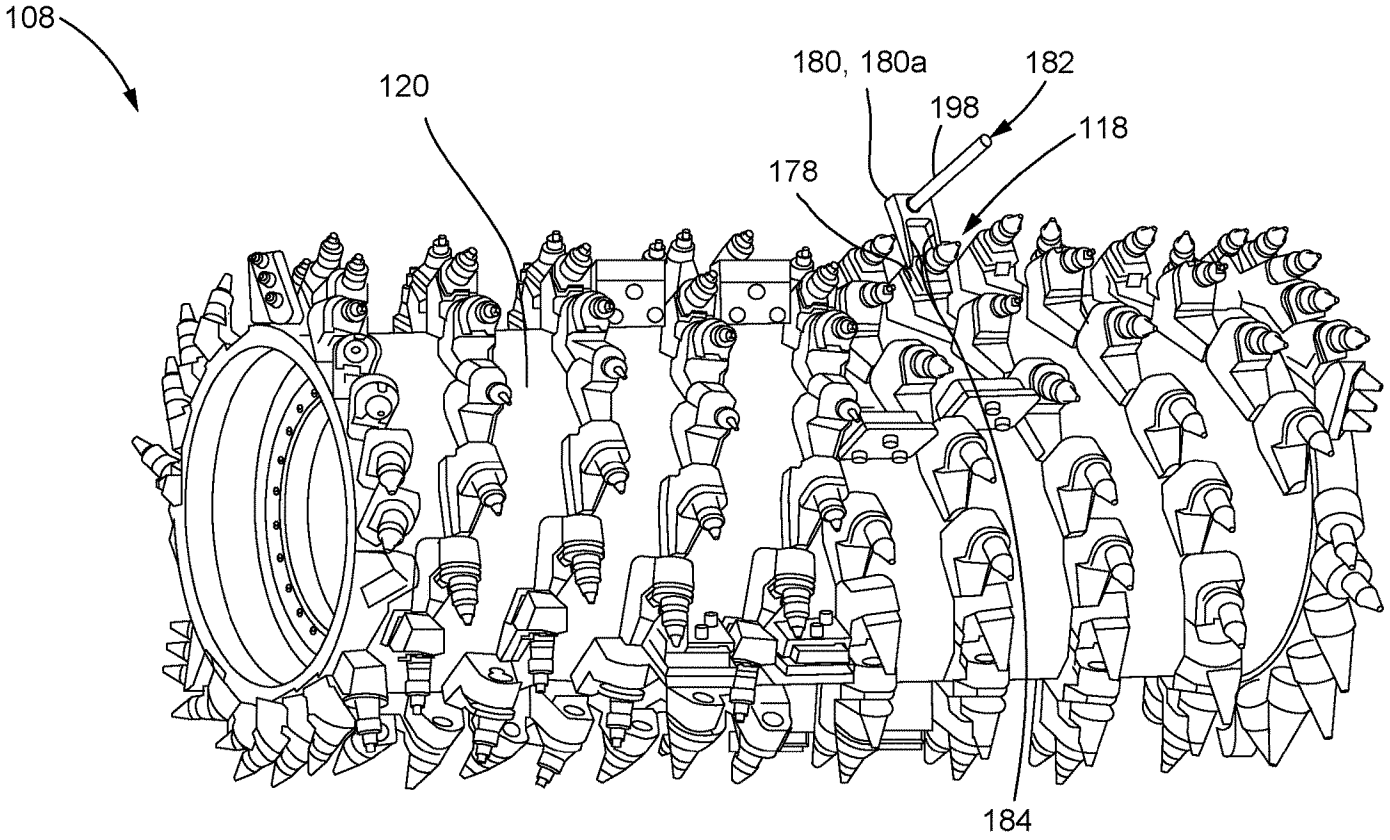
FIG. 7 an illustration of the forks of the hammer positioned in the wedge channels of the exemplary mounting block assembly disposed on the milling drum.

In the embodiment illustrated in FIGS. 3 and 7, there are a two parallel wedge channels 178 in the mounting block assembly 118. The (parallel) wedge channels 178 are positioned on opposite sides of the sidewall 146 on either side of a second recess 164 (discussed hereunder). In one embodiment, the two parallel wedge channels 178 are disposed approximately equidistant from a twelve o'clock position 192 centered on the second recess 164 as shown in FIG. 3. The wedge channel 178 may include a tapered wall 200 and is configured to receive a portion of a head 180 (for example a forked head 180*a*), or the like, of a hammer 182 or similar tool used to pry or dislodge the toolholder 130 off the mounting portion 136, if needed, during servicing. FIGS. 6-7 illustrate this best. As shown in FIG. 7, the forks 184 of a forked head 180*a* of a hammer 182 may be inserted into the pair of wedge channels 178 in the mounting block assembly 118. As shown in FIG. 6, force is applied to the head 180, 180*a* in the direction shown by arrow 186 to pry the ledge 160 of the toolholder 130 off of the upper face 174. The hammer 182 may then be utilized to further pry or pop the toolholder 130 out of the first bore 144.

The sidewall 146 may also define a second recess 164 (best seen in FIGS. 3 and 5) disposed opposite to the first recess 154, and may also define an internal channel 165. The internal channel 165 may, in one embodiment, be generally perpendicular to the axis X. The second recess 164 may intersect the second bore 148 (FIG. 4) via the internal channel 165 in the toolholder 130. The internal channel 165 may provide access to an internal end of cutting bit 132 such that the cutting bit 132 may be pried out of tool holder 130 during servicing. Both the second recess 164 and the internal channel 165 may be disposed at approximately the twelve o'clock position 192 (on an opposite side of the second bore 148 than the upper surface 142 of the flighting portion 134).

The cutting bit 132 may comprise a generally cylindrical stem 150 configured to be received within tool holder 130, and a pointed, hardened tip 153 that engages road surface 114 during operation when the milling drum 108 rotates. In some embodiments, the cutting bit 132 may also include a spring clip that surrounds the cylindrical stem 150 and functions to retain cutting bit 132 within tool holder 130, as is known in the art.

INDUSTRIAL APPLICABILITY

Also disclosed is a method of assembling a mounting block assembly 118 on a milling drum 108. The method may comprise: fixedly securing the mounting block 128 to the milling drum 108, positioning a toolholder 130 above the mounting block 128, aligning the protrusion 138 inside the prongs 152 and disposing (e.g., press-fitting) the toolholder 130 in the mounting portion 136 of the mounting block 128, wherein the protrusion 138 is disposed between the prongs 152 in an interlocking relationship, wherein further the interlocked configuration of the toolholder 130 and the mounting block 128 inhibit rotational movement of the toolholder 130 about the axis X.

Because the interlocking relationship inhibits (or stops) rotational movement of the toolholder 130 in the mounting block 128 during use of the milling drum 108, the second recess 164 and internal channel 165 remain positioned at approximately the twelve o'clock position 192 (on an opposite side of the second bore 148 than the upper surface 142 of the flighting portion 134) (see FIGS. 2-4) and do not rotate to a different position proximal to either the first or second side 194, 196 of the mounting block 128. This ensures that appropriate tools can be inserted into the internal channel 165 via the second recess 164 and leverage applied to such tools to remove the cutting bit 132 without interfering with other mounting block assemblies 118 disposed on the milling drum 108.

Similarly, another benefit of the interlocking relationship occurs when the toolholder 130 must be removed during servicing. Because the interlocking relationship inhibits (or stops) rotational movement of the toolholder 130 in the mounting block 128 during operation of the milling drum 108, the wedge channels 178 remain positioned on opposite sides of the second recess 164 (generally centered on the second recess 164 and disposed equidistant from the twelve o'clock position 192) (see FIGS. 2-3 and 6-7), thus ensuring that the forks 184 (or the like) of the hammer 182 can easily be inserted and leverage applied by the hammer 182 without interfering with other mounting block assemblies 118 disposed on the milling drum 108. Because removal of the toolholder 130 may require strong leverage force, the handle 198 (possibly a relatively long one) of the hammer 182 may need to be utilized as a lever to dislodge and remove the toolholder 130. Thus, it is beneficial to have space surrounding the handle 198 that is unobstructed by other mounting block assemblies 118 so that the handle 198 may be easily used as a lever.

The features disclosed herein may be particularly beneficial to machines 100 such as cold planers 102, rotary mixers, and the like that utilize a milling drum 108 having a cutting bit 132 attached thereon. The interlocking configuration of the toolholder 130 and mounting block 128 not only increases the ease with which the mounting block assembly 118 may be serviced but also reduces friction wear and stress on the toolholder 130 and mounting block 128. This increases the longevity of the components and results in less maintenance and repair downtime for the machine 100.

What is claimed is:

1. A mounting block assembly for a milling drum, the assembly comprising:

a mounting block, the mounting block including:

a flighting portion configured to engage an outer cylindrical surface of the milling drum;

a mounting portion that defines a first bore configured to receive a toolholder, the mounting portion having an upper face; and a protrusion that extends away from the mounting portion, wherein the flighting portion, the mounting portion and the protrusion are integral; and the toolholder including:

a generally cylindrical sidewall having a ledge, the sidewall defining an axis and a second bore extending in a direction parallel to the axis, the second bore configured to receive a stem of a cutting bit, the ledge including a pair of prongs and a pair of cutouts, the prongs extend radially outward from the ledge in a direction generally perpendicular to the axis, the pair of cutouts and the upper face define a pair of wedge channels, the prongs define a first recess therebetween, and the first recess configured to interlockably receive the protrusion when the toolholder is disposed in the mounting portion, wherein:

the interlocked configuration of the toolholder and the mounting block inhibit rotational movement of the toolholder about the axis;

the first recess includes a first side, a second side, and a back;

the first side is opposite from and parallel to a second side; and the first side and the second side extend perpendicularly from the back.

2. The mounting block assembly of claim 1, wherein the sidewall defines a second recess opposite to the first recess, and defines an internal channel, wherein further the second recess intersects the second bore via the internal channel.

3. The mounting block assembly of claim 1, wherein the protrusion extends in a direction generally parallel to the axis.

4. The mounting block assembly of claim 1 wherein a portion of the ledge is the back.

5. A method of assembling a mounting block assembly on a milling drum, the method comprising:

fixedly securing a mounting block to the milling drum, the mounting block including a flighting portion configured to engage an outer cylindrical surface of the milling drum, a mounting portion having an upper face, the mounting portion defines a first bore configured to receive a toolholder, and a protrusion that extends away from the mounting portion, wherein the flighting portion, the mounting portion and the protrusion are integral;

positioning the toolholder above the mounting block, the toolholder including a generally cylindrical sidewall having a ledge, the sidewall defining an axis and a second bore extending in a direction parallel to the axis, the second bore configured to receive a stem of a cutting bit, the ledge including a pair of prongs and a pair of cutouts, the prongs extend radially outward from the ledge in a direction generally perpendicular to the axis, the pair of cutouts and the upper face define a pair of wedge channels, the prongs define a first recess therebetween, and the first recess is configured to interlockably receive the protrusion when the toolholder is disposed in the mounting portion, wherein:

the interlocked configuration of the toolholder and the mounting block inhibit rotational movement of the toolholder about the axis;

the first recess includes a first side, a second side, and a back;

the first side is opposite from and parallel to a second side; and the first side and the second side extend perpendicularly from the back;

aligning the protrusion inside the prongs; and disposing the toolholder in the mounting portion of the mounting block, wherein the protrusion is disposed between the prongs in an interlocking relationship, wherein the interlocked configuration of the toolholder and the mounting block inhibit rotational movement of the toolholder about the axis.

6. The method of claim 5, wherein the sidewall defines a second recess opposite to the first recess.

7. A milling drum comprising:

an outer cylindrical surface;

a mounting block including:

a flighting portion configured to engage the outer cylindrical surface;

a mounting portion having an upper face, the mounting portion defines a first bore configured to receive a toolholder; and a protrusion that extends away from the mounting portion, wherein the flighting portion, the mounting portion and the protrusion are integral; and the toolholder including:

a generally cylindrical sidewall having an annular ledge and a pair of cutouts, the sidewall defining an axis and a second bore extending in a direction parallel to the axis, the second bore configured to receive a stem of a cutting bit, the sidewall including a pair of prongs that extend radially outward from the annular ledge in a direction generally parallel to the axis, the upper face and the pair of cutouts define a pair of wedge channels, the prongs define a first recess therebetween, and the first recess is configured to interlockably receive the protrusion when the toolholder is disposed in the mounting portion, wherein:

the interlocked configuration of the toolholder and the mounting block inhibit rotational movement of the toolholder about the axis;

the first recess includes a first side, a second side, and a back;

the first side is opposite from and parallel to a second side; and the first side and the second side extend perpendicularly from the back.

8. The milling drum of claim 7, in which the milling drum further includes a cutting bit disposed in the second bore.

9. The milling drum of claim 8, wherein the milling drum is disposed on a machine.

10. The milling drum of claim 9, wherein the machine is a cold planer.

* * * * *